US006253491B1

(12) United States Patent
Pages

(10) Patent No.: US 6,253,491 B1
(45) Date of Patent: Jul. 3, 2001

(54) DEVICE AND PROCESS FOR MOUNTING CABLES ON A DRUM OF AN AUTOMOBILE VEHICLE WINDOW RAISER

(75) Inventor: Philippe Pages, Orleans (FR)

(73) Assignee: Meritor Light Vehicle System-France (FR)

( * ) Notice: Subject to any disclaimer, the term of this patent is extended or adjusted under 35 U.S.C. 154(b) by 0 days.

(21) Appl. No.: 09/099,853

(22) Filed: Jun. 19, 1998

(30) Foreign Application Priority Data

Jun. 24, 1997 (FR) ..... 97 07866

(51) Int. Cl.[7] ..... E05F 11/48
(52) U.S. Cl. ..... 49/352; 49/349
(58) Field of Search ..... 49/352, 332, 348, 49/349, 501; 242/125.1, 74; 74/501.5, 502.6, 89.22

(56) References Cited

U.S. PATENT DOCUMENTS 4,421,299 * 12/1983 Hess ..... 254/342
4,607,456 * 8/1986 Shiraishi et al. ..... 49/352
4,753,125 * 6/1988 Fukumoto et al. ..... 74/501.6
4,759,653 * 7/1988 Maekawa et al. ..... 403/24
4,840,080 * 6/1989 Kobayashi et al. ..... 74/501.5 R
4,970,911 * 11/1990 Ujihara et al. ..... 74/501.5 R
4,995,568 * 2/1991 Yamagishi et al. ..... 242/125.1
6,094,868 * 8/2000 Otaka et al. ..... 49/349

FOREIGN PATENT DOCUMENTS

164693A2 6/1985 (EP) .
2199889A 12/1987 (GB) .

* cited by examiner

*Primary Examiner*—Daniel P. Stodola
*Assistant Examiner*—Curtis A. Cohen
(74) *Attorney, Agent, or Firm*—Carlson, Gaskey & Olds

(57) ABSTRACT

A device for completing the assembly of a window raiser mechanism. The device includes a cover (12) partly surrounding the drum (1) for winding the cables. At the base of the drum (1) a circular tunnel (16) defines a peripheral passage for manually inserting the hooking pellet of the second cable (4). The end pellet of the first cable (3) is inserted in the opening and this cable is then wound on the drum (1) by adjusting this winding in such manner that the opening for the pellet of the second cable (4) is accessible to an operator and that a slider (6), which is fixed to the first cable, is in the end-of-travel abutment position. Then the second cable (4) is manually inserted around the drum (1) on substantially one turn until it is possible to place its end pellet (19) in the corresponding opening (21). Then the loop formed by the two cables is closed.

16 Claims, 5 Drawing Sheets

DEVICE AND PROCESS FOR MOUNTING CABLES ON A DRUM OF AN AUTOMOBILE VEHICLE WINDOW RAISER

BACKGROUND OF THE INVENTION

The present invention relates to a process for mounting cables on a drum of an automobile vehicle window raiser and a device for carrying out said process.

A vehicle window raiser usually comprising two cables each provided with an end lock or "pellet" for insertion in a corresponding opening on the periphery of the drum constituting its socket so as to permit the closure of a loop formed by the two cables when assembling the window raiser.

As is known, when mounting on a window raiser assembly line the cables and their drum in the corresponding window raiser, it is necessary to avoid, when the slider fixed to the lower cable is in its lower abutment or stop position and a pull is exerted in this lower abutment position of the slider, pulling directly on the pellet of the cable. Indeed, a pull exerted directly on the pellet could break the drum, which is composed of plastics material.

It is therefore necessary to distribute the pulling force on the drum by winding the cable extending from the pellet on the drum on the minimal part of the circumference of the drum, in practice about ⅓ of a turn, with the slider in its lower abutment position.

Further, the device employed for this assembly comprises, in addition to the drum disposed with its axis of rotation vertical, a plate for supporting the latter, and a cover partly covering the drum. Means for fixing the base of the cover to the plate are provided, for example collars. Normally this cover surrounds substantially one half of the circumference of the drum.

Now, in order to satisfy the condition of a minimal winding of the cable, usually the aforementioned lower cable of the window raiser, it is in practice necessary to effect a relatively long and complicated sequence of operations on the manual assembly line. Indeed, when the lower cable has been hooked or attached to the drum and wound several turns around the latter with the slider in the lower abutment position on the guide rail of the window raiser, the opening constituting the socket for the end pellet of the upper cable is angularly positioned at this moment within the cover and is therefore inaccessible to the operator.

The closure of the loop is then impossible. Consequently, in order to pursue the assembly, the operator is obliged to effect the following sequence of operations:

1) disengagement of the lower cable from the slider and the rail (this lower cable of the window raiser being on the assembling device in fact placed at the upper end of the drum),
2) hooking of the lower cable on a guide support usually constituted by a carriage termed "saddle",
3) creation of an additional rotational travel of the drum to disengage the hooking opening from the upper cable, which in the employed assembling device is in fact hooked at the base of the drum,
4) positioning of the end pellet of the upper cable on the drum,
5) a rearward return for replacing the lower cable,
6) displacement of the slider to the lower abutment position.

In other words, at the beginning of the foregoing sequence, the lower cable is wound on the drum a few turns, and the drum is brought to a position in which the end pellet of the upper cable can be hooked; but one is then no longer in the position corresponding to the lower abutment and this requires a rearward return movement.

It should be mentioned that the hooking of the first cable must be effected at the top of the drum. In practice, this first cable is the lower cable of the window raiser, but it could also be the upper cable.

In any case, the sequence of the assembling operations described hereinbefore corresponds to three hookings of the cable, a winding travel and two extra assembling travels. Such a process is therefore relatively long and demanding of the operator.

An object of the invention is to provide a process for mounting cables on the drum of a window raiser in accordance with a notably simplified sequence which therefore facilitates the work of the operator and reduces the time required for this assembly, and the corresponding device for carrying out said process.

SUMMARY OF THE INVENTION

According to the invention, the process for mounting cables on a drum of a vehicle window raiser comprises several basic steps. First, the end pellet of a first cable is inserted in its opening and the cable is wound on the drum and adjusted in such a manner that the opening for the pellet of the second cable is accessible to an operator and that a slider fixed to the first cable is in the end-of-travel abutment position. The second cable is then manually inserted around the drum on substantially one turn until it is possible to place its end pellet in the corresponding opening. Lastly, the loop is closed.

This sequence corresponds to two cable hookings and one winding travel. The process according to the invention therefore eliminates an intermediate step in the prior sequence of mounting operations which is therefore simplified.

The device for carrying out the inventive process includes a drum for winding two cables, a cover for maintaining the drum and partly surrounding the latter by leaving a part of its circumference accessible, and a plate for fixing the cover and supporting the drum.

According to the invention, the cover is so shaped as to include at its base adjoining the plate a tunnel defining with the plate a peripheral passage permitting the manual insertion of a pellet for hooking a cable and the insertion of the latter on substantially one turn around the drum until its end pellet can be disposed in the corresponding opening.

This tunnel therefore extends substantially over one half of a circumference around the drum corresponding to the angular extent of the cover. Its width and height are so dimensioned as to permit the insertion between the wall of the tunnel and the drum of the pellet for hooking the cable.

Owing to the stiffness and resilience of the cable, its pellet may be inserted by exerting a thrust on the cable around the drum while it is guided by the wall of the tunnel up to the associated hooking opening in which the operator manually inserts the pellet and hooks the cable.

It will be understood that the length of the two cables must be so adjusted that, in the lower abutment position of the slider of the window raiser, the opening for the hooking of the pellet of the upper cable is accessible to the operator to permit the hooking of the pellet in the corresponding opening.

Further features and advantages of the invention will be apparent from the following description which illustrates an embodiment of the invention by way of a non-limitative example. The drawings that accompany the detailed description can be described as follows.

DETAILED DESCRIPTION OF THE PREFERRED EMBODIMENTS

Figure 1:
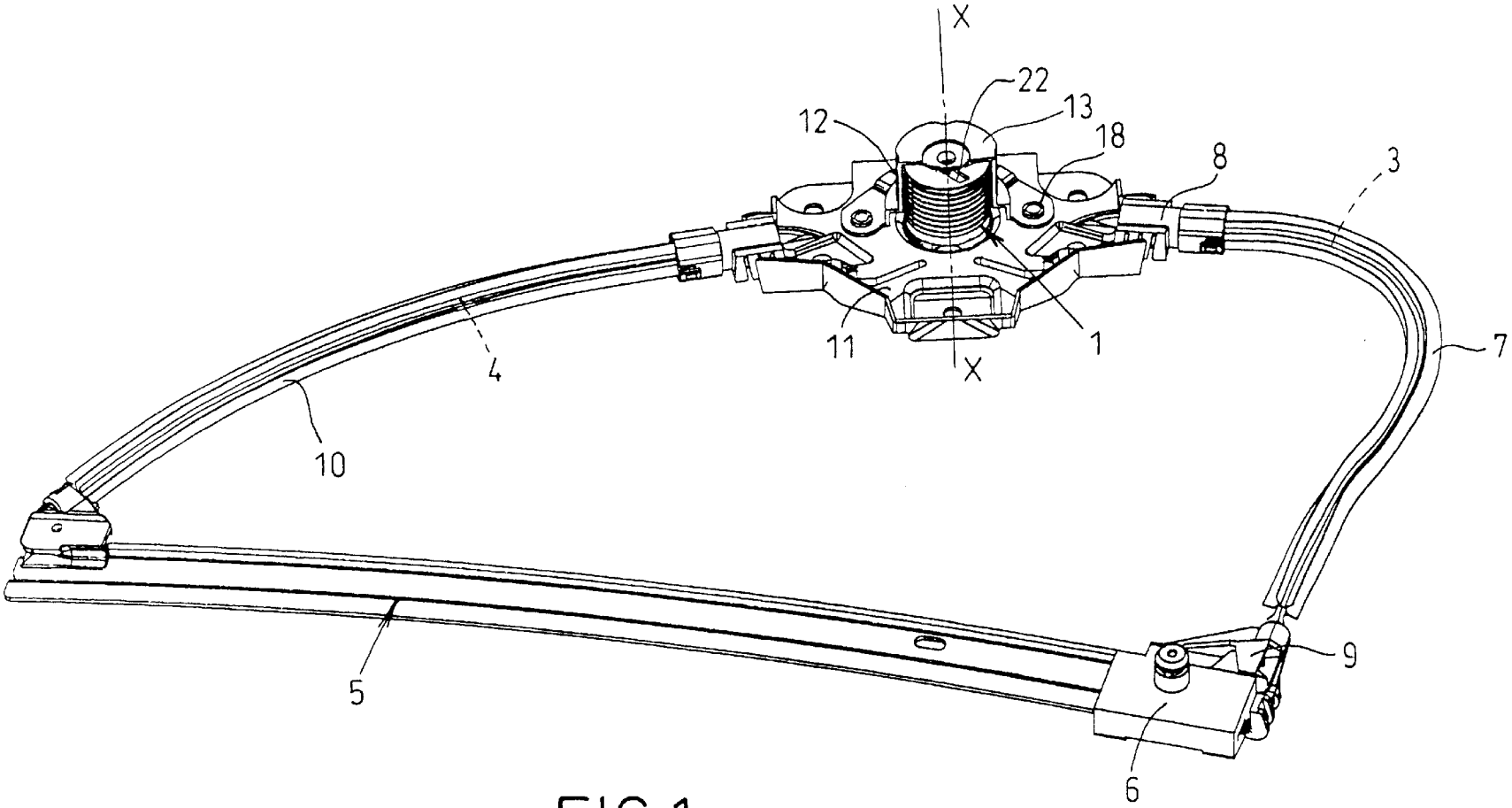
FIG. 1 is a perspective view of an embodiment of a vehicle window raiser incorporating a mounting device according to the invention.

The device illustrated in the drawings comprises a drum 1 whose periphery is provided with a series of grooves 2 for receiving a lower cable 3 and an upper cable 4 of a window raiser. A rail 5 guides the cables 3, 4 and a slider supports a window glass (not illustrated).

The lower cable 3 of the window raiser is wound from the upper end of the drum while the lower cable 4 must be wound from its lower end. "Upper and "lower" are terms used as shown in the illustrations and are not otherwise limiting.

The lower cable 3 is disposed in a sheath 7 provided with a fastener 8, and a slider 6, sliding on the rail 5. The slider 6 is shown in FIG. 1 in the lower position against the corresponding lower abutment or stop 9. The upper cable 4 is disposed in a sheath 10.

The drum 1 is disposed on a support plate 11 and is rotatable about an axis of rotation illustrated as the line x—x. The drum 1 is partly disposed within a cover 12 which, when viewed from above, extends angularly over about half a circumference of the drum 1 (see FIG. 2, for example). The cover 12 comprises an end wall 13 which covers substantially one half of the upper face of the drum 1, a cylindrical part 14 extends from the end wall 13. The cylindrical part 14 has an inside diameter which preferably is very slightly larger than the diameter of the drum 1 to permit the drum to rotate within the cover 12.

An annular shoulder 15 extends from the base of the cylindrical part 14 in a direction roughly parallel to the plate 11. The shoulder 15 constitutes an annular step which defines with the drum 1 a corresponding inner tunnel 16. This shoulder 15 is extended by lugs 17 which are applied against the surface of the plate 11 to which they are secured by suitable means, such as formed-over collars or rivets 18.

Figure 3:
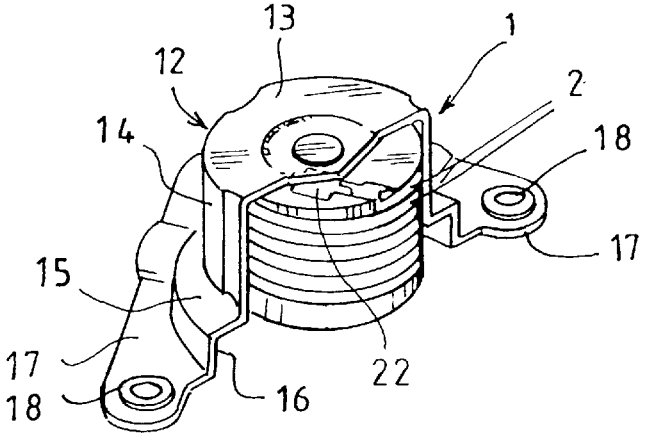
FIG. 3 is a perspective view of the drum, cover and plate of the device of FIG. 1.
Figure 4:
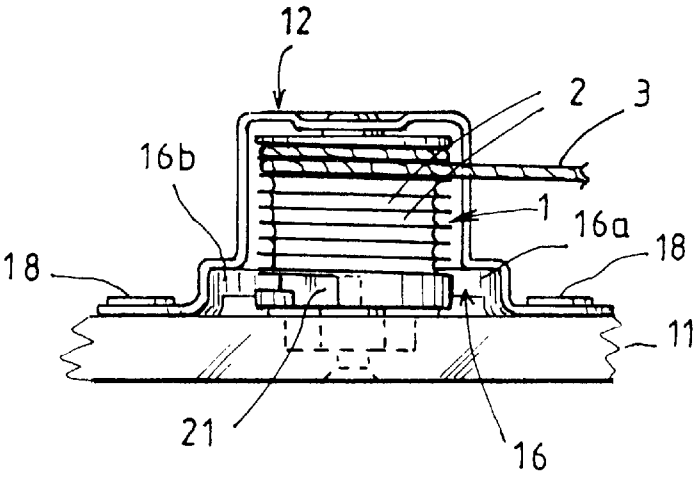
FIG. 4 is an elevational view of the drum, cover and plate of the device of FIGS. 1 to 3, the lower cable being shown hooked in position and wound several turns around the drum and the opening for hooking the pellet of the upper cable being accessible to the operator outside the cover.
Figure 7:
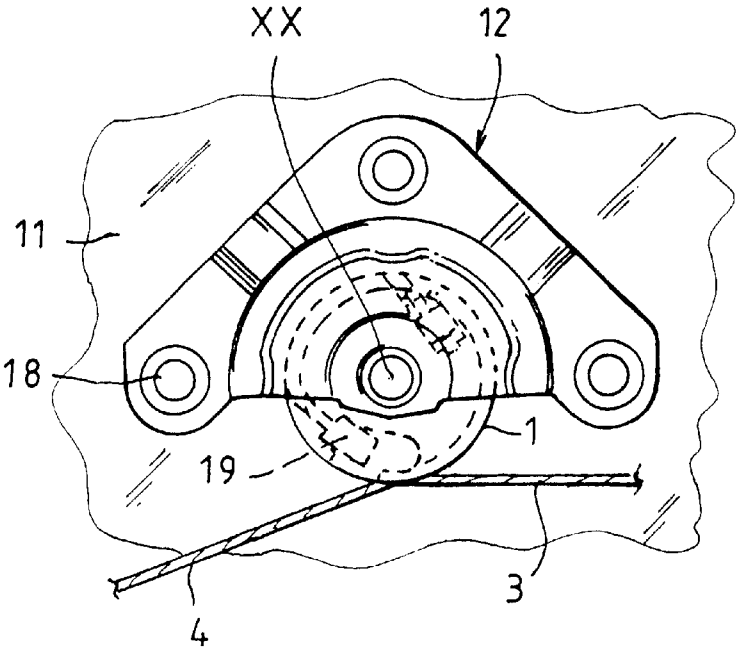
FIG. 7 is a top plan view corresponding to FIG. 6.

The shoulder 15 extends radially around the cylindrical part 14 and is so dimensioned that, in cross-section, the tunnel 16 permits the insertion and passage of the end pellet 19 of the upper cable 4 in the corresponding hooking opening 21 when the latter is accessible outside the cover 12 (FIGS. 1, 3 and 4).

The hooking opening 21 of the upper cable is provided, as shown, in the known manner at the base of the drum 1, while the hooking opening 22 of the lower cable 3 is at the upper end of the drum (FIG. 4).

The openings 21 and 22 preferably are angularly spaced apart roughly half a circumference.

Figure 2:
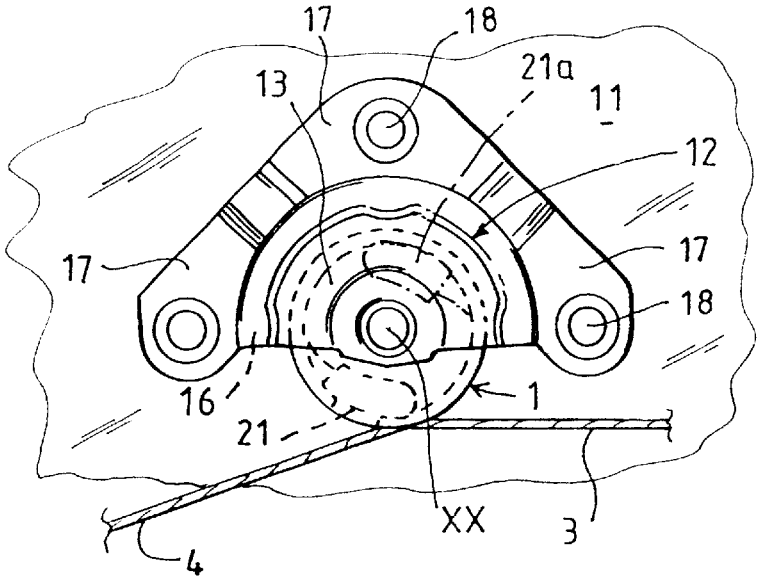
FIG. 2 is a top plan view of the device for mounting two cables on the drum in the window raiser of FIG. 1.

Shown at 21*a* in FIG. 2 is the hooking opening for the pellet 19 of the cable 4 where it appeared in the prior art after the winding of the first cable 3 and the positioning of the slider 6 in the lower abutment position; it can be seen that this opening 21*a* was not accessible to the operator since it was placed under the cover and required the aforementioned complicated sequence of operations.

Figure 5:
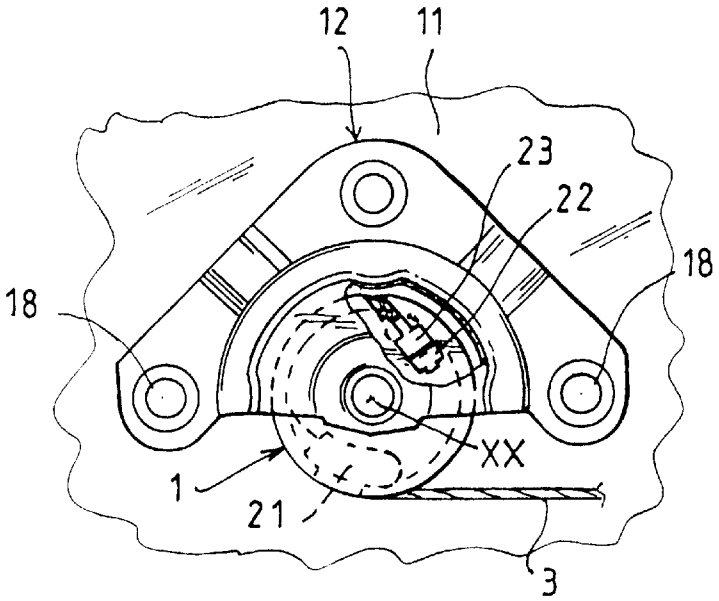
FIG. 5 is a top plan view corresponding to FIG. 4.
Figure 6:
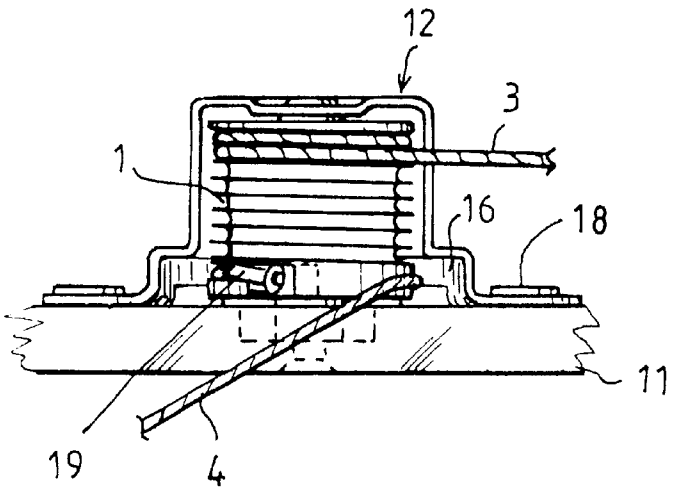
FIG. 6 is a view similar to FIG. 4 illustrating the insertion of the upper cable in the tunnel to permit the hooking of its end pellet in the corresponding opening of the drum.
Figure 9:
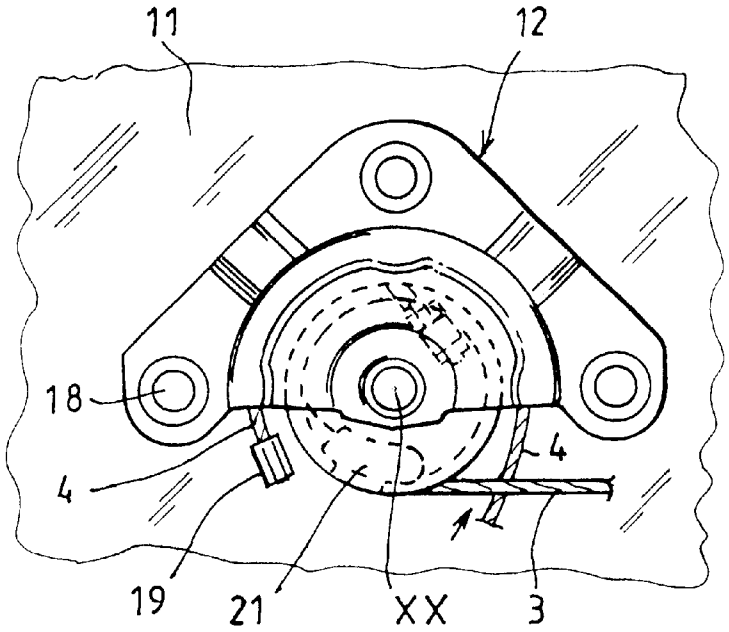
FIG. 9 is a top plan view corresponding to FIG. 8 illustrating the closure of the loop.
Figure 8:
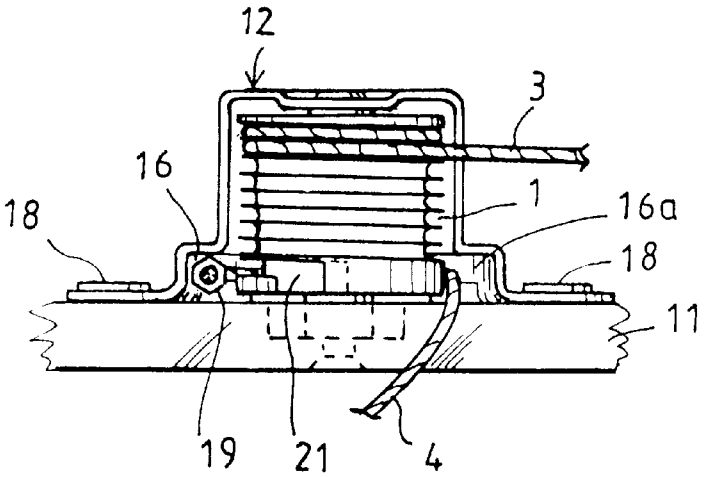
FIG. 8 is an elevational view similar to FIG. 6 showing the lower cable with its pellet disposed in the corresponding opening of the drum after having travelled through substantially one turn around the drum, a part of which is inside the tunnel of the cover.

The mounting of the cables 3 and 4 on the drum 1 to permit the closure of the corresponding loop most preferably is effected in the following manner. The end pellet 23 of the first cable 3 is inserted and this first cable 3 is wound several turns on the drum 1. The adjustment of this winding is such that, when the slider 6 is placed against the lower abutment or stop 9, the opening 21 for receiving the pellet 19 of the second cable 4 is accessible to the operator, (i.e., appears outside the cover 12) (FIGS. 3 and 4). The second cable 4 is manually inserted around the drum 1 by placing its end pellet 19 in the entrance 16a of the tunnel 16 (on the right in FIGS. 3 and 4). Then, while holding the cable 4, the operator pushes the cable 4 into the tunnel 16, the wall of which and the flexibility of the cable 4 effectively guide the pellet 19 around the drum 1 inside the cover 12 until the pellet 19 reappears at the outlet 16*b* of the tunnel 16 after having travelled through about half a circumference (FIGS. 5 and 6). The operator then manually inserts the pellet 19 in the corresponding opening 21 and the second cable 4 is then wound one turn around the drum 1. The slider 6 remains in the lower abutment position during this portion of the process. The operator can then close the loop of the window raiser formed by the two cables 3 and 4 with no other particular handling operation.

It can be seen that this sequence of operations is notably simplified with respect to the sequence of operations of the prior art.

The cover 12 could possibly cover the drum 1 on an angular sector smaller than as illustrated. However, in practice, it is difficult to considerably reduce this angular sector of the covering of the drum owing to essential considerations of the strength of the cover and the steadiness of the drum 1.

The preceding description is exemplary and not limiting in nature. Variations and modifications may become apparent that do not depart from the purview and spirit of the invention. The scope of legal protection is limited only by the following claims including all legal equivalents.

What is claimed is:

1. A device for carrying out a process for mounting cables of an automobile window raiser having a first cable and a second cable with a first end pellet and a second end pellet, said device comprising in combination:

a drum having a first opening and a second opening on a periphery of said drum to permit hooking the cables to said drum and closing a loop formed by said cables, a cover for rotably supporting said drum and a partly surrounding said drum while leaving accessible a part of the circumference of said drum, said cover having a first portion having a first diameter and extending in an axial direction of said drum, and a second portion having a second diameter larger than the first diameter, and a plate supporting said cover and supporting said drum such that said drum is received between said plate and said cover, said second poriton, located between said first portion and said plate and a radial portion located adjacent said second portion, and forming an arcuate tunnel defining with said drum a peripheral passage that arcuately guides one of the end pellets around a turn of at least 135 degrees for permitting a manual insert of the end pellet and the respective cable on substantially one turn around said drum after the drum is received between said plate and said cover such that the end pellet can subsequently be disposed in the respective opening of said drum.

2. Device according to claim 1, wherein said cover is arcuate.

3. Device according to claim 2, wherein said respective openings for hooking said two cables are angularly spaced apart about half of a circumference.

4. A vehicle window raiser assembly, comprising:

a plate;

a cover supported on said plate, said cover including a base portion adjacent said plate, an end wall distal from said base portion, and a side wall extending between said base portion and said end wall, said side wall having a first segment with a nominal inside radius and a second segment with a second inside radius that is greater than said nominal radius;

a drum rotably supported between said cover and said plate for rotable movement relative to said cover and said plate, said first segment extending axially along a portion of said drum and said second segment located between said first segment and said plate and a radial portion located adjacent said second segment said drum including a first end and a second end with a grooved side wall extending between said ends, a first opening near said first end of said drum and a second opening near said second end of said drum, said first end of said drum including an axial face that is at least partially exposed after said drum is received between said cover and said plate, said first opening being accessible after said drum is received between said cover and said plate when said drum is in a first rotated position, said second opening being accessible after said drum is received between said cover and said plate when said drum is in a second rotated position.

5. The assembly of claim 4, further comprising a first cable at least partially wound about said drum and a second cable at least partially wound about said drum.

6. The assembly of claim 5, wherein said drum includes a plurality of grooves on a periphery of said drum and wherein said first and second cables are at least partially received by said grooves.

7. The assembly of claim 4, wherein said first and second openings are spaced apart by approximately by 180°.

8. The assembly of claim 7, further comprising a first cable having an end pellet at one end of said first cable and a second cable having an end pellet at one end of said second cable, said first cable pellet being received in said first opening on said drum and said second cable pellet being received in said second opening on said drum such that said ends of said cables remain fixed relative to said drum.

9. The assembly of claim 8, wherein said second segment of said side wall has an axial length and wherein said pellets have an outside dimension and wherein said axial length of said second side wall segment is slightly greater than said outside dimension of said pellets such that said pellets can be selectively moved within a spacing defined between said drum and said inside diameter of said second side wall portion.

10. The assembly of claim 9, wherein said side wall second portion is immediately adjacent said base portion.

11. The assembly of claim 4, wherein said cover end wall covers over only approximately one-half of one end of said drum.

12. The assembly of claim 4, wherein said cover side wall extends around approximately one-half of a periphery of said drum.

13. The assembly of claim 4, wherein the second segment of said side wall forms an arcuate guiding channel that is adapted to receive and guide an end pellet on a cable arcuately around the portion of the drum after the drum has been received between said cover and said plate such that the end pellet can be received in a corresponding opening in said drum subsequent to said drum being received between the cover and said plate.

14. A vehicle window raiser assembly, comprising:

a plate;

a cover supported on said plate, said cover including a base portion adjacent said plate, an end wall distal from said base portion, and a side wall extending between said base portion and said end wall, said side wall having a first segment with a nominal inside radius and a second segment with second inside radius that is greater than said nominal radius; and a drum rotably supported between said cover and said plate for rotable movement relative to said cover and said plate, said drum being generally cylindrical and wherein said cover end wall and side wall have an arcuate length that is less than a circumference of said drum said first segment extending axially along a portion of said drum and said second segment located between said first segment and said plate and a radial portion located adjacent said second segment.

15. The assembly of claim 14, wherein said cover end wall covers over approximately one-half of one end of said drum.

16. The assembly of claim 14, wherein said cover side wall extends around approximately one-half of a periphery of said drum.

* * * * *